US005947752A

United States Patent [19]

Wu

[11] Patent Number: 5,947,752

[45] Date of Patent: Sep. 7, 1999

[54] VIDEO DATA TRANSMISSION CONNECTOR AND TRANSMISSION CABLE MOUNTING ARRANGEMENT

[75] Inventor: Peter Wu, Taipei, Taiwan

[73] Assignee: Gorden Su, Taipei, Taiwan

[21] Appl. No.: 09/093,860

[22] Filed: Jun. 9, 1998

[51] Int. Cl.[6] ..... H01R 9/09

[52] U.S. Cl. ..... 439/76.1; 439/676; 439/404

[58] Field of Search ..... 439/76.1, 892, 439/676, 404

[56] References Cited

U.S. PATENT DOCUMENTS

| | | | |
|---|---|---|---|
| 5,091,826 | 2/1992 | Arnett et al. | 439/76.1 |
| 5,403,200 | 4/1995 | Chen | 439/404 |
| 5,624,274 | 4/1997 | Lin | 439/676 |
| 5,688,145 | 11/1997 | Liu | 439/607 |
| 5,885,111 | 3/1999 | Yu | 439/676 |

*Primary Examiner*—Steven L. Stephan
*Assistant Examiner*—Hae Moon Hyeon
*Attorney, Agent, or Firm*—Varndell Legal Group

[57] ABSTRACT

A video data transmission connector and transmission cable mounting arrangement includes a connector holder having a holder base and a hollow shell integral with the holder base, the hollow shell of the connector holder having a top mounting block and a bottom mounting hook for installation in a hole on a patch panel, wall plate or surface mount box, a circuit board mounted in the connector holder, a video data transmission connector welded to a front part of the circuit board and received inside the hollow shell of the connector holder with a front receiving side thereof aimed at an insertion hole on the hollow shell for receiving a matching electric connector, an insulation displacement connector welded to a rear part of the circuit board and coupled to two opposite upright side walls of the holder base, a video data transmission cable connected to the insulation displacement connector for video data transmission with the video data transmission connector through the circuit board, and a holding down cap fastened to the insulation displacement connector to hold down wires of the video data transmission cable in respective wire slots in the insulation displacement connector.

1 Claim, 5 Drawing Sheets

VIDEO DATA TRANSMISSION CONNECTOR AND TRANSMISSION CABLE MOUNTING ARRANGEMENT

BACKGROUND AND SUMMARY OF THE INVENTION

The present invention relates to a video data transmission connector and transmission cable mounting arrangement which can be conveniently installed in a patch panel, a wall plate, or a surface mount box.

FIG. 1 shows a regular video data transmission connector designed for mounting on a circuit board in a video camera, or a video data transmission card in a computer peripheral apparatus. This structure of video data transmission connector can not be directly mounted in a patch panel, wall plate or surface mount box in building, or directly connected to a video data transmission cable. Therefore, the application of this structure of video data transmission connector is limited.

The present invention has been accomplished under the circumstances in view. It is the main object of the present invention to provide a video data transmission connector and transmission cable mounting arrangement which can be conveniently installed in a patch panel, a wall plate, or a surface mount box. According to one aspect of the present invention, the video data transmission connector and transmission cable mounting arrangement comprises a connector holder having a holder base and hollow shell integral with the holder base, the hollow shell of the connector holder having a top mounting block and a bottom mounting hook for installation in a hole on a patch panel, wall plate or surface mount box, a circuit board mounted in the connector holder, a video data transmission connector welded to a front part of the circuit board and received inside the hollow shell of the connector holder with a front receiving side thereof aimed at an insertion hole on the hollow shell for receiving a matching electric connector, an insulation displacement connector welded to a rear part of the circuit board and coupled to two opposite upright side walls of the holder base, a video data transmission cable connected to the insulation displacement connector for video data transmission with the video data transmission connector through the circuit board, and a holding down cap fastened to the insulation displacement connector to hold down wires of the video data transmission cable in respective wire slots in the insulation displacement connector. According to another aspect of the present invention, the holding down cap and the insulation displacement connector are fastened together by plugging respective upright mounting rods of the insulation displacement connector into respective downwardly extended coupling tubes of the holding down cap.

DETAILED DESCRIPTION OF THE PREFERRED EMBODIMENT

Figure 1:
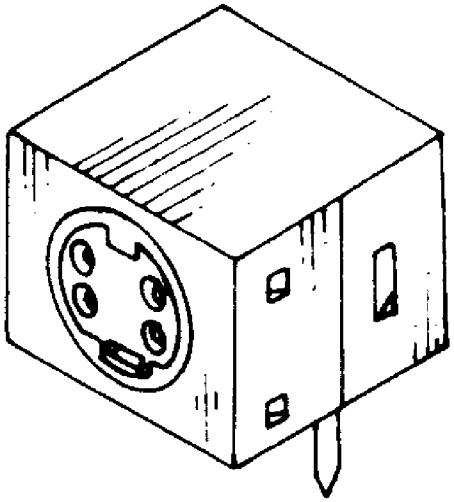
Fig. 1 PRIOR ART
FIG. 1 is a perspective view of a regular video data transmission connector.

Referring to FIGS. from 2 to 5, a video data transmission connector and transmission cable mounting arrangement in accordance with the present invention is generally comprised of a connector holder 1, an insulation displacement connector 2. a video data transmission connector 3, a circuit board 4, and a holding down cap 5.

Figure 2:
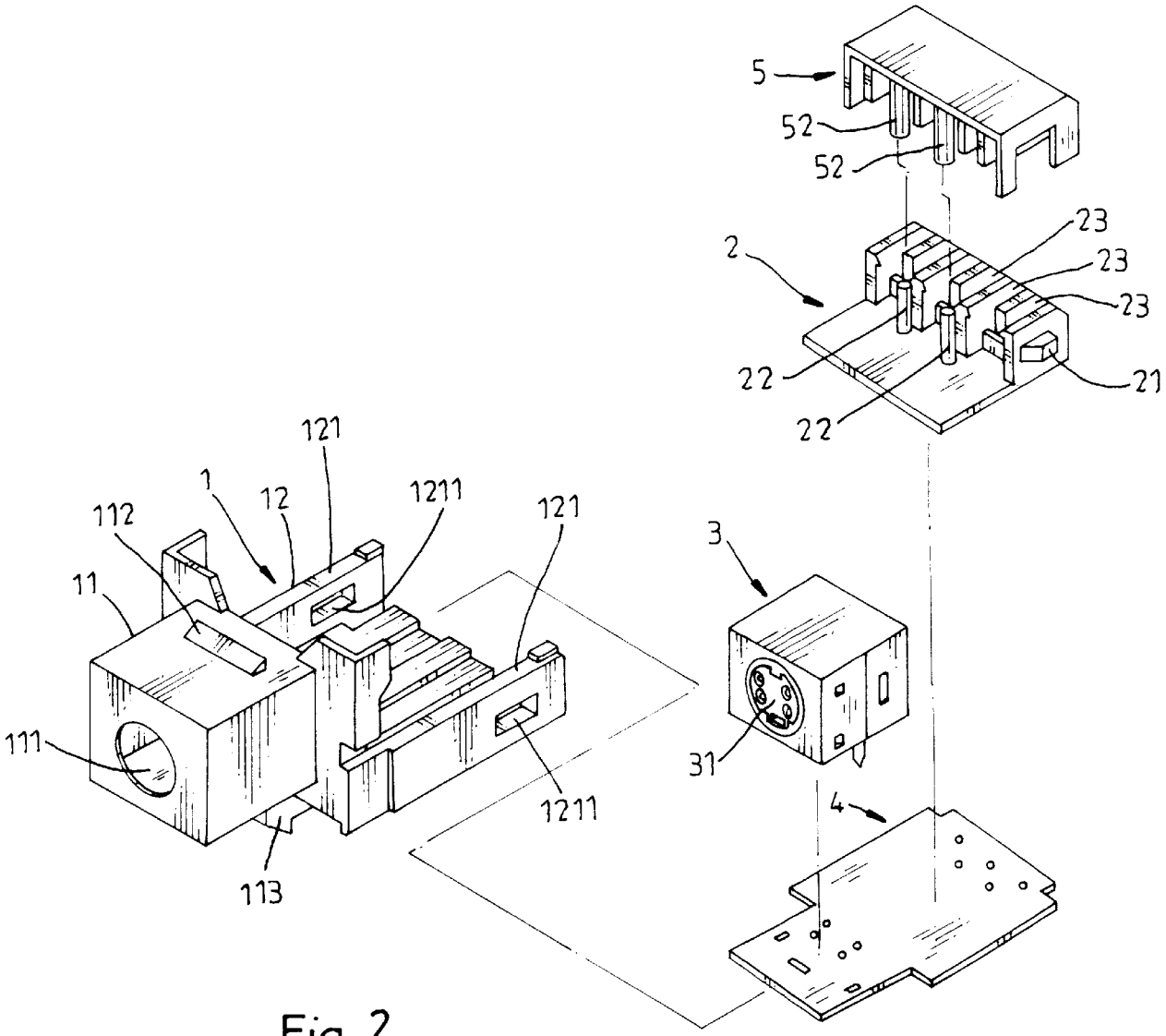
FIG. 2 is an exploded view of the present invention (the video data transmission cable excluded).
Figure 5:
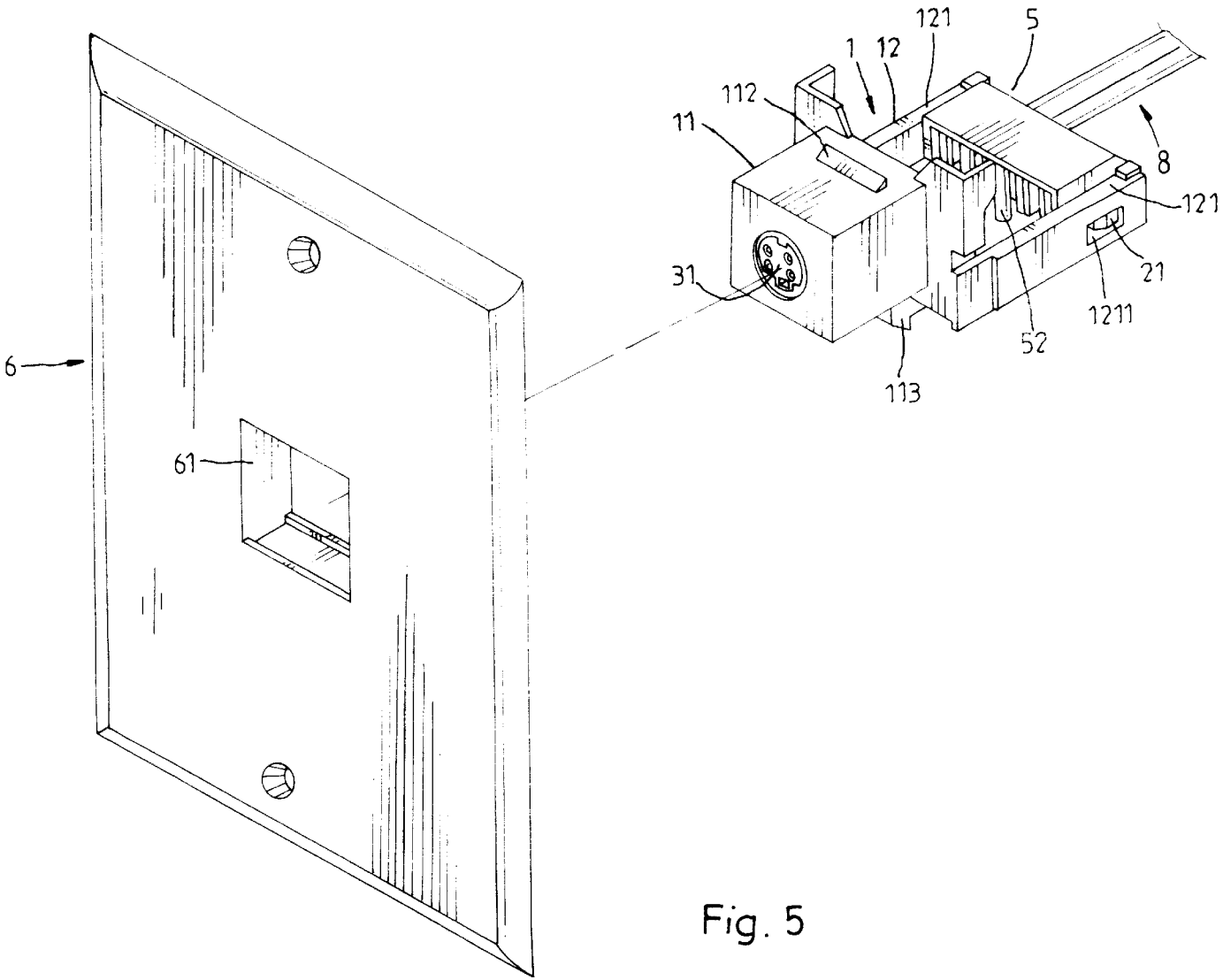
FIG. 5 shows the relation between the assembly of the present invention and a wall plate.

Referring to FIGS. 2 and 5, the connector holder 1 comprises a holder base 12, and a hollow shell 11 integral with the holder base 12 at a front side thereof. The holder base 12 has two upright lateral side walls 121, each lateral side wall 121 having a respective retaining hole 1211. The hollow shell 11 comprises a front insertion hole 111 at a front side wall thereof, a top mounting block 112 integral with a top side wall thereof, and a bottom mounting hook 113 integral with a bottom side wall thereof. The back side of the hollow shell 11 is an opened side through which the video data transmission connector 3 and a part of the circuit board 4 are inserted into the hollow shell 11. By means of the top mounting block 112 and the bottom mounting hook 113, the hollow shell 11 of the connector holder 1 can be fastened to a patch panel (not shown), the mounting hole 61 on a wall plate 6 (see FIG. 5), or the mounting hole on a surface mount box (not shown). The video data transmission connector 3 is welded to a front part of the circuit board 4, and then inserted with the front part of the circuit board 4 into the hollow shell 11 of the connector holder 1, permitting the receiving side 31 of the video data transmission connector 3 to be aimed at the insertion hole 111 on the hollow shell 11 for receiving a matching electric connector. The insulation displacement connector 2 is welded to a rear part of the circuit board 4, and mounted with the circuit bard 4 in the connector holder 1. The insulation displacement connector 2 comprises two retaining blocks 21 raised from two opposite upright side walls thereof for engagement with the retaining holes 1211 on the upright lateral side walls 121 of the holder base 12 of the connector holder 1, parallel wire slots 23, and two upright mounting rods 22 for connection to the holding down cap 5. The holding down cap 5 is fastened to the insulation displacement connector 2 to hold down a video data transmission cable 8, having two downwardly extended coupling tubes 52 for engagement with the upright mounting rods 22 of the insulation displacement connector 2.

Figure 3:
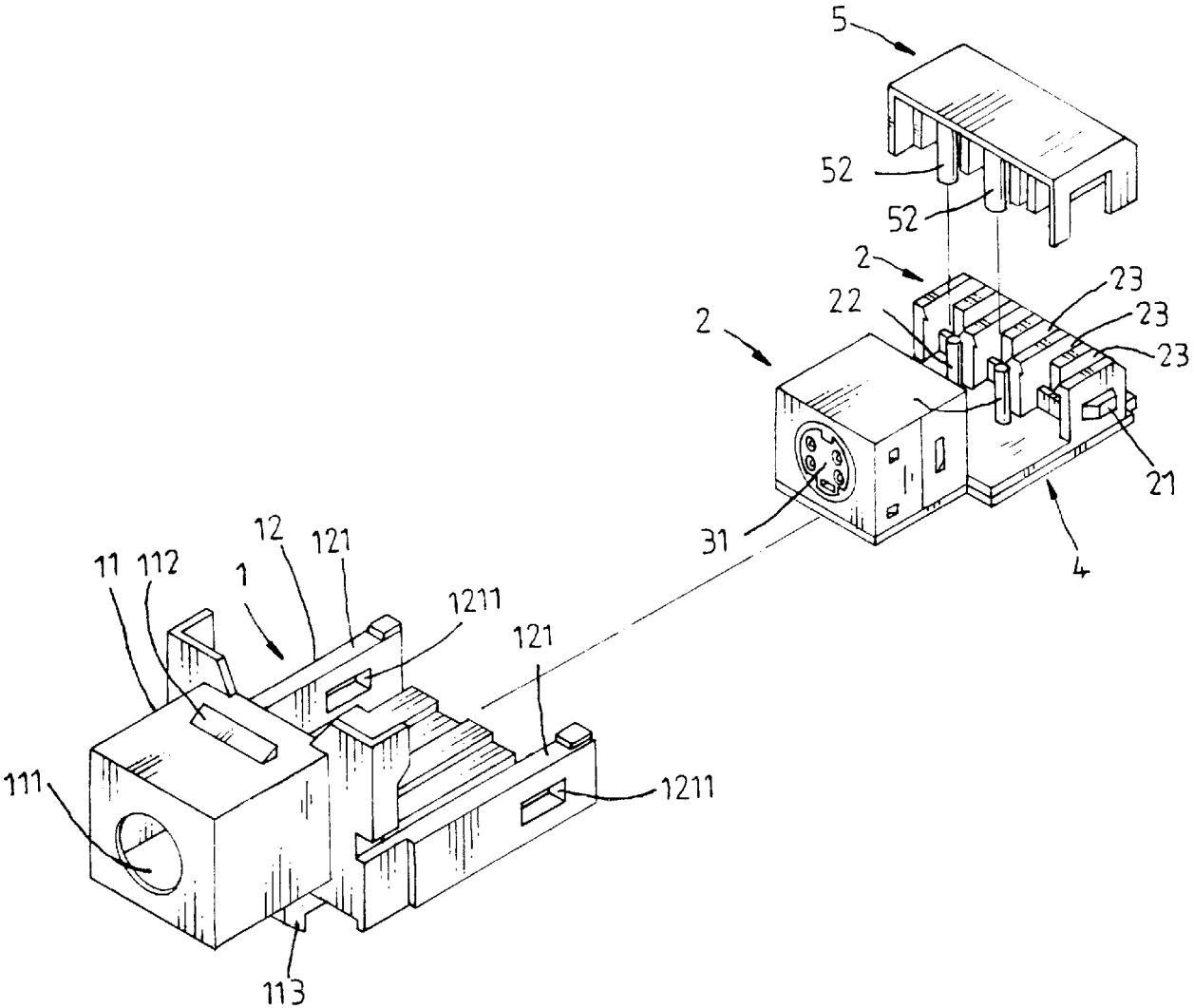
FIG. 3 is similar to FIG. 2 but showing the video data transmission connector and the insulation displacement connector welded to the circuit board.
Figure 4:
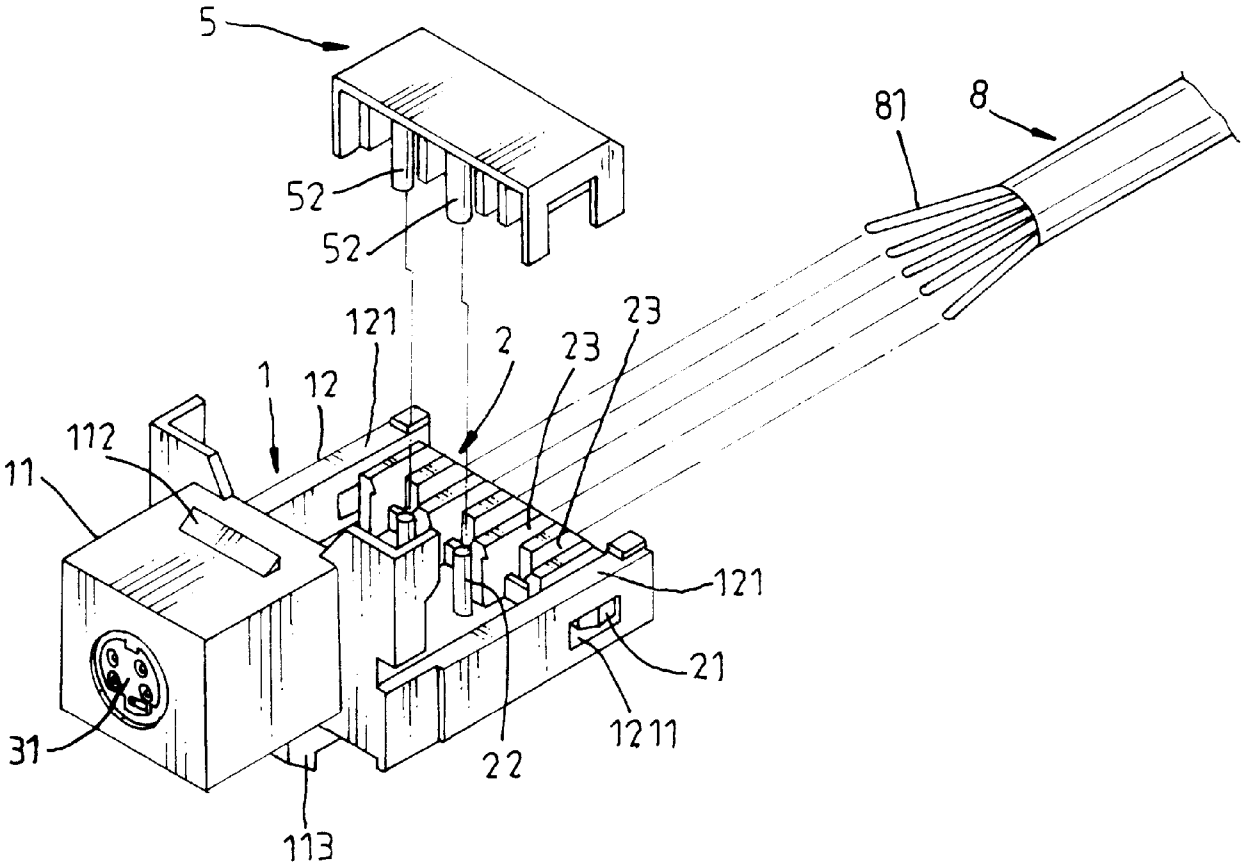
FIG. 4 shows the assembly of the video data transmission connector, the insulation displacement connector and the circuit board mounted in the connector holder according to the present invention.

Referring to FIGS. from 2 to 5 again, when the insulation displacement connector 2 and the video data transmission connector 3 are respectively welded to the circuit board 4 (see FIG. 3), the circuit board 4 is inserted into the connector holder 1, enabling the video data transmission connector 3 to be received in the hollow shell 11 and the retaining blocks 21 of the insulation displacement connector 2 to be respectively forced into engagement with the retaining holes 1211 on the upright lateral side walls 121 of the holder base 12 (see FIG. 4), and then the wires 81 of the video data transmission cable 8 are respectively inserted into the wire slots 23 in the insulation displacement connector 2 to touch respective terminals (not shown) in the wire slots 23, and then the holding down cap 5 is fastened to the insulation displacement connector 2 to hold down the video data transmission cable 8 (see FIGS. 4 and 5). By plugging the upright mounting rods 22 of the insulation displacement connector 2 into the downwardly extended coupling tubes 52 of the holding down cap 5, the holding down cap 5 and the insulation displacement connector 2 are fastened together. When installed, the video data transmission cable 8 is electrically connected to the video data transmission connector 2 through the circuit board 4.

I claim:

1. A video data transmission connector and transmission cable mounting arrangement comprising:

a connector holder, said connector holder comprising a holder base, and a hollow shell integral with a front side of said holder base, said holder base having two upright lateral side walls, said upright lateral side walls each having a retaining hole, said hollow shell comprising a front insertion hole at a front side wall thereof, a top mounting block integral with a top side wall thereof, a bottom mounting hook integral with a bottom side wall thereof, and a rear open side;

a circuit board mounted in said holder base, said circuit board having a front part inserted into said hollow shell of said connector holder through the rear open side of said hollow shell, and a rear part carried on said holder base of said connector holder;

a video data transmission connector welded to the front part of said circuit board and received inside said hollow shell of said connector holder, said video data transmission connector having a front receiving side aimed at the insertion hole on said hollow shell for receiving a matching electric connector;

an insulation displacement connector welded to the rear part of said circuit board, said insulation displacement connector comprising two retaining blocks raised from two opposite upright side wall thereof and respectively engaged into the retaining holes on the upright lateral side walls of said holder base of said connector holder, parallel wire slots, and two upright mounting rods;

a video data transmission cable connected to said insulation displacement connector for video data transmission with said video data transmission connector through said circuit board, said video data transmission cable having a plurality of wires respectively inserted into the wire slots in said insulation displacement connector and connected to respective terminals in the wire slots in said insulation displacement connector; and a holding down cap fastened to said insulation displacement connector to hold down the wires of said video data transmission cable in the wire slots in said insulation displacement connector, said holding down cap comprising two downwardly extended coupling tubes respectively coupled to the upright mounting rods of said insulation displacement connector.

* * * * *